US005746514A

United States Patent [19]

Orensten

[11] Patent Number: 5,746,514

[45] Date of Patent: May 5, 1998

[54] LAUNDRY BAG AND METHOD OF USING SAME

[75] Inventor: Henry E. Orensten, Wayzata, Minn.

[73] Assignee: O & P Company, Inc., Wayzata, Minn.

[21] Appl. No.: 643,002

[22] Filed: May 3, 1996

[51] Int. Cl.[6] ..... B65D 30/06

[52] U.S. Cl. ..... 383/66; 383/88; 383/89; 383/117; 383/907

[58] Field of Search ..... 383/66, 86.1, 86.2, 383/88, 89, 92, 117, 907

[56] References Cited

U.S. PATENT DOCUMENTS

| | | | |
|---|---|---|---|
| 177,749 | 5/1876 | Redden | 383/92 X |
| 570,174 | 10/1896 | Knight | 383/117 X |
| 618,943 | 2/1899 | Kahnweiler | 383/61 X |
| 632,842 | 9/1899 | May | 383/89 X |
| 1,572,605 | 2/1926 | Howe | 383/117 X |
| 1,589,570 | 6/1926 | Samble | 383/92 X |
| 1,991,827 | 2/1935 | Todd | 383/117 X |
| 2,080,252 | 5/1937 | Cook | 383/92 X |
| 2,565,394 | 8/1951 | Ryan | 383/66 |
| 3,422,867 | 1/1969 | Wu | 383/66 |
| 3,955,227 | 5/1976 | Siegfried . | |
| 4,010,785 | 3/1977 | Patik | 383/117 X |
| 4,388,739 | 6/1983 | Martinon et al. . | |
| 4,630,312 | 12/1986 | Milstein | 383/117 X |
| 4,714,353 | 12/1987 | Leaphart . | |
| 4,974,967 | 12/1990 | Tsuyoshi et al. . | |
| 5,050,999 | 9/1991 | Van Loon, III . | |
| 5,082,466 | 1/1992 | Rubenstein et al. . | |
| 5,320,429 | 6/1994 | Toyosawa . | |

FOREIGN PATENT DOCUMENTS

| | | | |
|---|---|---|---|
| 3-49667 | 10/1991 | Japan . | |
| 18818 | 8/1910 | United Kingdom | 383/117 |

*Primary Examiner*—Jes F. Pascua

*Attorney, Agent, or Firm*—Mueting, Raasch, Gebhardt & Schwappach, P.A.

[57] ABSTRACT

The laundry bag includes a body of openwork material defining a substantially spherical interior volume in at least one state and having an opening thereto. A closure is positioned at the opening to close the opening while maintaining the substantially spherical interior volume. The closure may include an additional body of openwork material extending from the opening and having an open end for inserting objects into the interior volume. Further, a laundry bag includes a body of openwork material defining an interior volume. The body of openwork material has an opening for insertion of objects into the interior volume and includes a closure portion of openwork material adjacent the opening such that when the closure portion is folded the interior volume is maintained. A method for using a laundry bag includes providing a laundry bag having a body of openwork material defining an interior volume and having an opening for insertion of objects into the interior volume. The body of openwork material includes a closure portion of openwork material adjacent the opening. The closure portion is folded such that when folded the interior volume is a substantially maintained. The method may further include maintaining the folded position during use of the bag with a fastener, such as by pinning.

9 Claims, 5 Drawing Sheets

LAUNDRY BAG AND METHOD OF USING SAME

FIELD OF THE INVENTION

The present invention relates generally to laundry bags and methods of using laundry bags. More particularly, the present invention relates to laundry bags for use in washing and drying objects inserted into the bags without removing the objects during the washing and drying cycles.

BACKGROUND OF THE INVENTION

One of the most frequently voiced customer complaints of, for example, nursing homes, hospitals or other businesses that perform laundry services for its customers is the loss of or damage of clothing they entrusted to such businesses. Such loss or damage of clothing results in substantial expenditure on part of the business to correct the problem.

Various causes may create the problem, but one significant cause is the removal of the objects, such as clothes, from a conventional type of laundry bag to be put through the washing and/or drying cycles. The clothes may be removed for various reasons. For example, with the use of a conventional laundry bag constructed of flat pieces of openwork material, e.g. mesh constructed in a generally rectangular shape, the clothes get caught in the corners of the bags and do not dry properly. Further, if a drawstring closure is utilized with such a bag, the drawstring gathered area of the bag creates additional areas for clothes to gather, ball up, and remain wet during the drying cycles as well as not being washed properly during the wash cycles. Because they do not dry or wash properly in conventional bags, the clothes are removed from the bags for washing and drying resulting in a greater chance of misplacement, damage, theft, etc.

Further, such conventional bags having pockets, corners, or gathered areas from, for example, a drawstring closure, or flat two-dimensional shaped conventional bags require a longer drying time to completely dry the objects in the bags. The objects or clothes in such bags do not open up properly from the baffles of the drying units. For example, they get caught in a gathered area and never get opened by the drying unit for effective drying. As a result, the clothes require a longer drying time and the energy and cost of providing complete drying of the objects is significantly increased. Further, such conventional bags are small bags for individual pieces of clothing, such as a sweater, lingerie, etc. Such small bags are not suitable for use with many pounds of clothing as wrinkling would occur if adequate room is not provided for the clothes to open properly while drying.

In many situations, if the clothes or objects are removed from the bag for washing and/or drying, labels are required to keep track of the ownership of such objects. Such labels may be annoying and the labeling activity is also a very time intensive activity. Further, labels frequently wash out or never get affixed, leading to the clothing being unidentifiable. Moreover, sorting time using labels produces high labor costs.

For the above reasons, there is a need in the industry for a laundry bag that can be utilized to wash and dry objects in the laundry bag without ever being removed therefrom. Such a bag should be capable of drying the objects without excessive energy use and damage to the objects.

SUMMARY OF THE INVENTION

The laundry bag and method of using the laundry bag in accordance with the present invention overcomes the problems described above. The present invention provides a laundry bag that can be used to wash and dry objects therein in an energy efficient manner, without removal of the objects from the bag and without damage to the objects. Further, with use of the present invention, labeling of the individual objects being washed and dried can be eliminated, if desired.

The laundry bag of the present invention includes a body of openwork material defining a substantially spherical interior volume in at least one state and having an opening thereto. A closure is positioned at the opening to close the opening while maintaining the substantially spherical interior volume.

In one embodiment of the laundry bag, the closure includes an additional body of openwork material extending from the opening and having an open end for inserting objects into the interior volume. Further with regard to this embodiment, the additional body of openwork material may include a generally cylindrical shaped neck portion. The open end of the generally cylindrical shaped neck portion is substantially equal in size to the opening to the interior volume.

In other embodiments of the laundry bag, the open end may have an opening larger in size than the opening to the interior volume or the open end may have an opening smaller in size than the opening to the interior volume. Further, the closure may be a zipper or any closure elements positioned about the opening having adherence therebetween.

Another laundry bag in accordance with the present invention includes a body of openwork material defining an interior volume. The body of openwork material has an opening for insertion of objects into the interior volume and includes a closure portion of openwork material adjacent the opening such that when the closure portion is folded the interior volume is a substantially maintained.

In other embodiments of this laundry bag, the closure portion of openwork material may be a generally cylindrical shaped neck portion or the closure portion of openwork material may include a tapered neck portion. Further, the interior volume may be a spherical volume in at least one state.

A method for using a laundry bag in accordance with the present invention includes providing a laundry bag having a body of openwork material defining an interior volume and having an opening for insertion of objects into the interior volume. The body of openwork material includes a closure portion of openwork material adjacent the opening. The closure portion is folded such that when folded the interior volume is a substantially maintained.

In other embodiments of the method, the method may further include maintaining the folded position during use of the bag with a fastener, such as by pinning the folded closure portion of openwork material and the fastener may be labeled.

In another embodiment of the method, the closure portion of openwork material is a generally cylindrical neck portion. The folding step then includes flattening the neck portion resulting in a first and second corner of the neck portion. The first comer and second comer are folded downward and toward each other resulting in a generally triangular-shaped folded neck. The generally triangular-shaped folded neck portion is then folded downward towards the body of openwork material and a pin is inserted through the folded generally triangular shaped folded neck portion.

DETAILED DESCRIPTION OF THE EMBODIMENTS

Figure 1:
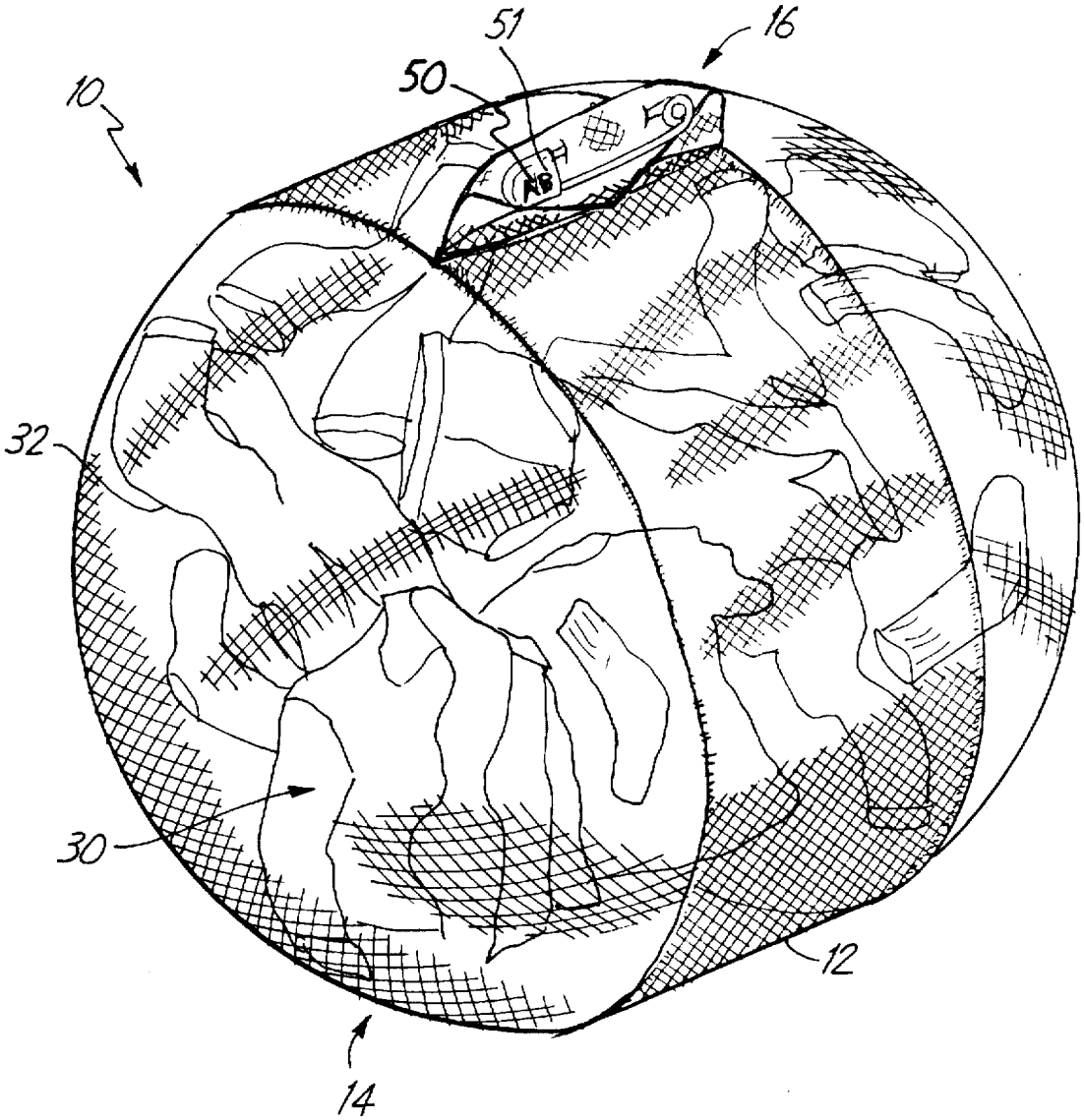
FIG. 1 is a perspective view of a laundry bag in accordance with the present invention showing the substantially spherical interior volume of the laundry bag with objects positioned therein.

A laundry bag 10 in accordance with the present invention shall be described with reference to FIG. 1. The laundry bag 10 includes a body of open work material 12. The openwork material 12 may be any net material, mesh material, weaved material, knitted material, or any other material having openings therein for allowing air to easily pass to the interior of the bag yet capable of holding objects therein. The openings may be of any size and the openwork material may be of a nylon material, a polyester material, a nylon/polyester material or any other material typically used for laundry bags of the nature described herein. The bag is preferably of a material easily dried or in other words, dried with a minimum amount of energy.

The laundry bag 10 generally includes a laundry retaining portion 14 of the body of openwork material 12 and a closure portion 16 of the body of openwork material 12. The laundry retaining portion 14 defines an interior retaining volume 30. The closure portion 16 includes an open end 20 defining opening 22 for insertion of laundry 32 via opening 18 into the interior volume 30 of the laundry bag 30.

The interior retaining volume 30 defined by the laundry retaining portion 14 is preferably a substantially spherical volume in an open and fall state, such as when the bag is completely filled with objects. The bag is generally of any three dimensional shape. Although the interior volume 30 of the laundry retaining portion 14 is not always in this substantially spherical state when used, such as shown in the FIGS. 2a–2c, the openwork material retaining portion 14 is substantially continuous about the interior volume enclosed by the laundry retaining portion 14 when the closure portion 16 is folded according to the method described further below. Substantially continuous refers to the fact that the interior volume is defined by material that does not have gathers, corners, or any other areas where laundry may accumulate, get caught, bunch, etc. In other words, the laundry when drying will not be trapped in an area of the bag preventing the effective drying of such laundry or adequate washing thereof. As such, for example, the baffles of a drying unit open the laundry effectively for efficient drying. Seams of the body of material 12 do not detract from or lessen the substantially continuous nature of the body of openwork material enclosing the interior volume 30.

Although the preferable interior volume is a spherical volume in at least one state, any shape of the body of openwork material that is substantially continuous may provide beneficial results. For example, a volume that has a more elliptical shape may provide adequate drying results.

The closure portion 16 extends generally from the opening 18 and includes the open end 20 forming the opening 22 for insertion of laundry to the interior volume 30. The closure portion 16 of the body of material 12 may take any number of configurations. For example, the closure portion may be substantially cylindrical as shown in FIG. 1, wherein the size of opening 18 and opening 22 are of about equal size. The opening 22 may be of a lesser size than opening 18 and as such the closure portion takes a tapered shaped with narrowing at the open end 20. Likewise the opening 22 could be larger in size than the opening 18 into the interior volume 30 and as such the closure portion takes a tapered shape in the reverse direction. The opening 22 being of a narrower size or a larger size than the opening 18 is shown in FIG. 2A by the dashed lines 43. Further, there may be other closure portions such as flaps which when folded in a particular manner could be utilized to close the opening 18 into the interior volume without reducing the interior volume and without interrupting the continuous nature of the interior volume.

The overall configuration of the body of material 12 may take different forms depending in most part on the configuration of the closure portion 16 utilized. For example, the configuration may be a pear shaped configuration when the closure portion is tapered or may resemble to separate elements, such as a circle and rectangle, especially if the closure portion 16 and retaining portion 14 are separate bodies of openwork material connected by a seam. However, the specific construction of the laundry bag, the number of pieces of openwork material utilized to form the laundry bag, or the overall size of the spherical volume are not to be taken as limits on the laundry bag in accordance with the present invention, as the present invention is limited only as described in the accompanying claims. Further, the closure portion 16 may be constructed of a non-openwork material if so desired, although it may not dry effectively and efficiently.

Figure 2A:
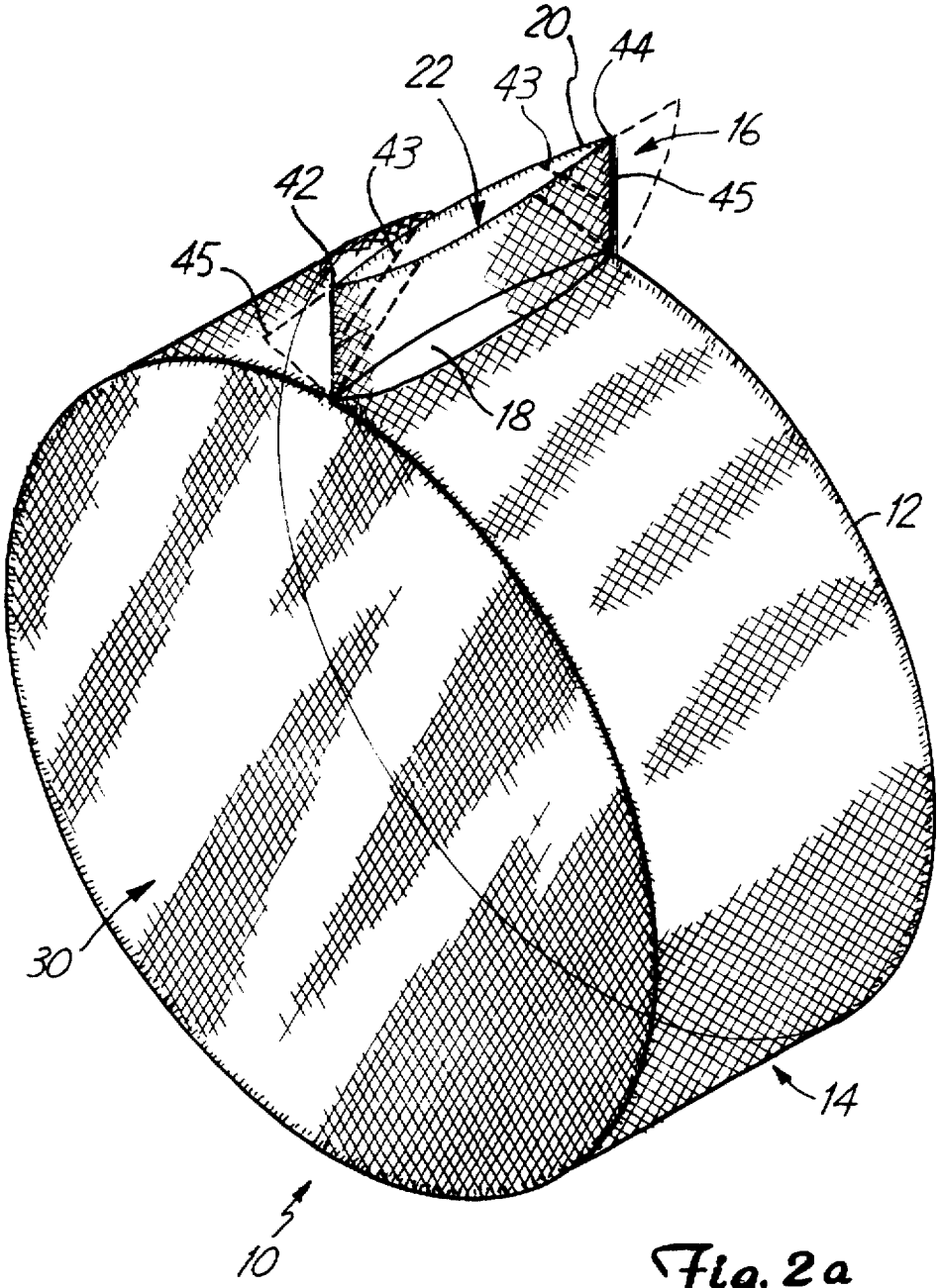
FIG. 2a–2c are perspective views of the laundry bag of FIG. 1 showing the steps of closing the laundry bag.
Figure 2B:
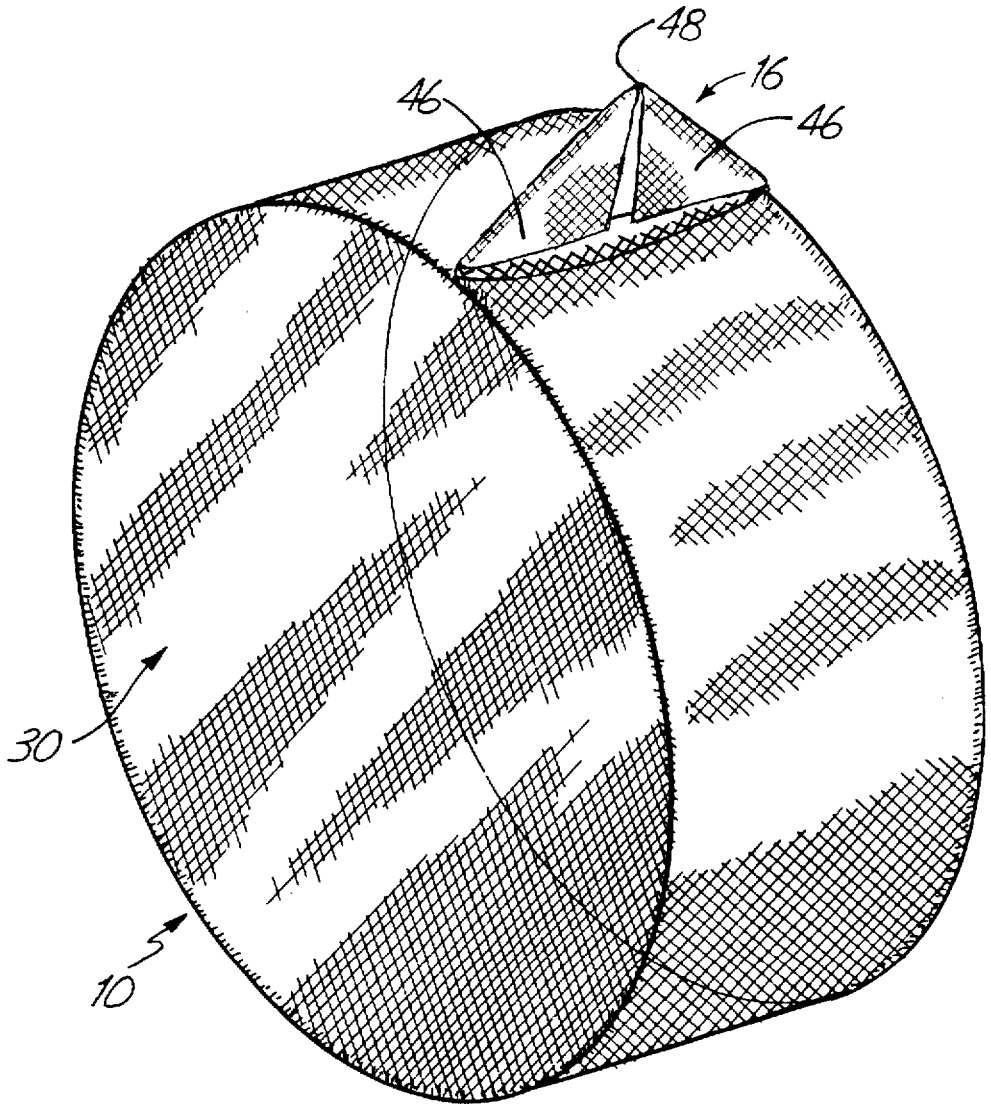
Figure 2C:
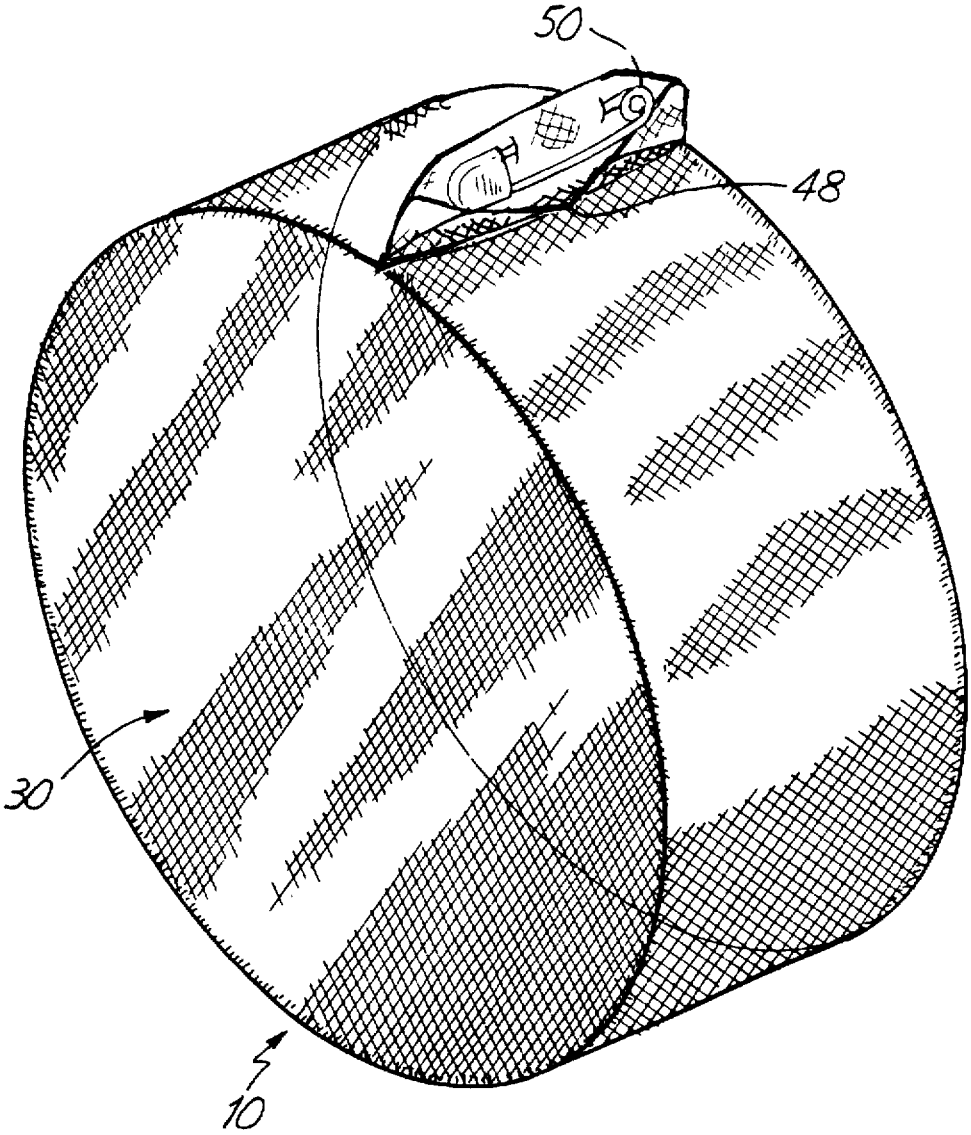

The method of using the laundry bag 10 as shown in FIG. 1 shall be described with reference to FIG. 2a–2c. After the laundry 32 is inserted into the interior volume 30 of laundry bag 10, the closure portion 16 is flattened forming a first corner 42 and a second corner 44 as shown in FIG. 2a. The first comer 42 and second corner 44 are then folded downward and toward each other resulting in a generally triangular-shaped folded neck 46 as shown in FIG. 2b. The generally triangular-shaped folded neck portion 46 has a tip 48 which is then folded downward towards the laundry retaining portion 14 of the body of openwork material 12 as shown in FIG. 2c. A fastener 50 is then used to hold and maintain the folds in place during the washing and drying cycles.

The laundry bag may be used, for example, in a nursing home or hospital setting. For illustration, the nursing home resident's laundry is placed in the laundry bag in the resident's room. The laundry stays in the bag during the entire cleaning process and then is returned to the resident's room. This reduces the chance of misplacement, theft, etc. of the resident's laundry. Further, such bags may be coded, such as by color, numbers, letters, or any other indicating means, to indicate a location of the resident's floor, building, etc.

The fastener 50 may be any fastener capable of holding the folded generally triangular shaped folded neck portion in place and further be capable of keeping any areas of or adjacent to the folded generally triangular shaped folded neck portion small enough to deter laundry from being trapped in such areas. For example, the fastener may be a pin, such as, for example, a stainless steel pin, inserted into the folds as shown in FIG. 2c. In order to show ownership of the laundry bag 10 and laundry 32 therein, the fastener 50, such as the pin, may be labeled, such as, for example, by engraving (FIG. 1, letters 51).

The folded closure portion as shown in FIG. 2c does not reduce the interior volume 30 of the laundry bag 10. Although very small pocket areas may be present at the closed opening 18, such openings are not large enough to trap, bunch, or otherwise hold or collect objects therein. Further, the closure portion provides an easy closure that is relatively inexpensive and extremely durable. For example, the pin is a fastener that is much less likely to break as compared to, for example, a zipper, or much less likely to wear out as in the case of, for example, snaps or Velcro.

Figure 3:
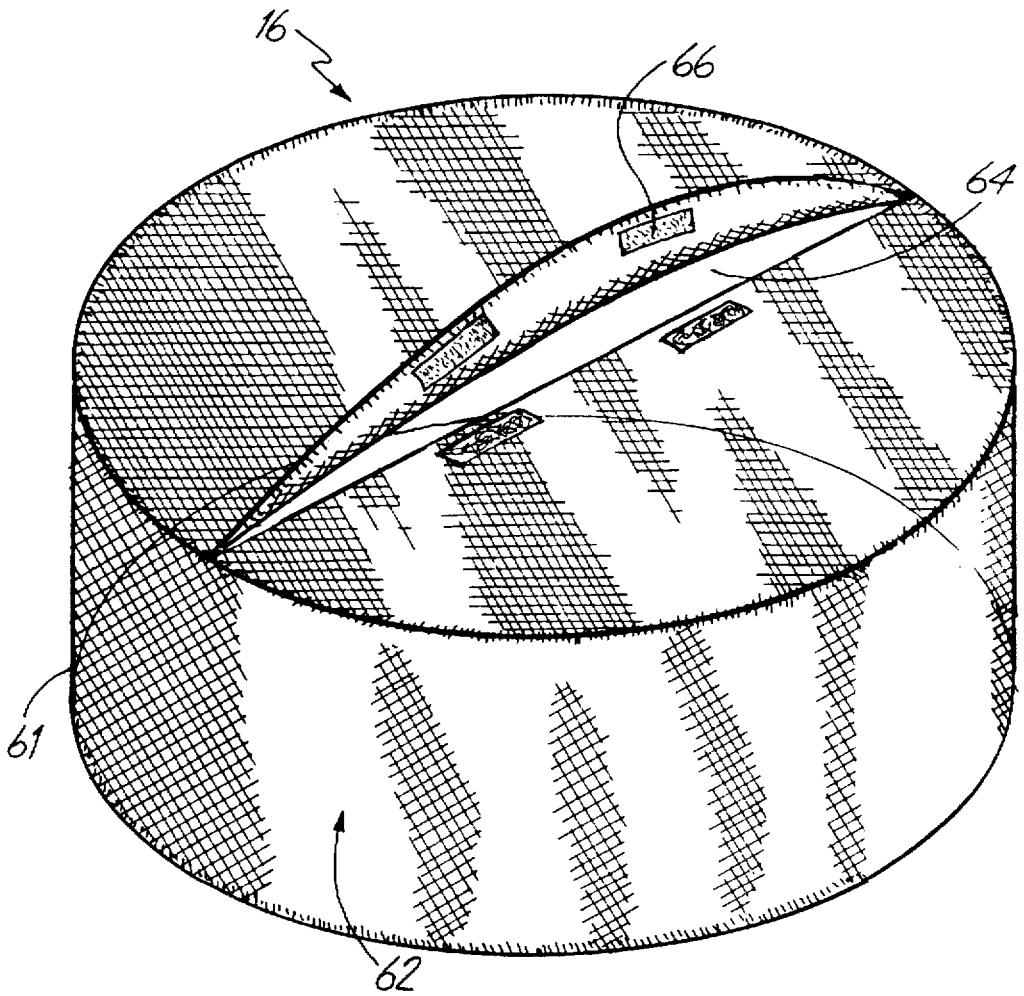
FIG. 3 is a perspective view of one alternative embodiment of a laundry bag in accordance with the present invention.

A laundry bag 60 having an alternative configuration is shown in FIG. 3. This laundry bag 60 does not include a closure portion made of openwork material, but rather includes other closure means 66 such as, for example, a zipper (not shown) or Velcro as shown in the FIG. 3. The laundry bag 60 includes a body of openwork material 61 defining an interior volume 62. The body of openwork material 61 includes an opening 64 for insertion of laundry therein. The interior volume 62 defined by the body of openwork material 61 is preferably a substantially spherical volume in an open and fall state similar to interior volume 30. Although the interior volume 62 does not typically take the substantially spherical shape when used, such as shown in the FIGS. 3, the openwork material is substantially continuous about the interior volume. Substantially continuous, as described previously, refers to the fact that the interior volume is defined by material that does not have gathers, corners, or any other areas where laundry may accumulate, get caught, bunch, etc., or in other words the laundry when dried will not be trapped in an area of the bag preventing the drying of such laundry or adequate washing thereof. As such and as previously described, baffles of a drying unit can open the laundry effectively for efficient drying.

Although the present invention has been described with particular reference to a preferred embodiment thereof, variation and modifications of the present invention can be made within a contemplated scope of the following claims as is readily known to one skilled in the art.

What is claimed is:

1. A laundry bag, comprising:

a body of openwork material defining a substantially spherical interior volume in at least one state, the body of openwork material having an opening to the interior volume; and a closure positioned at the opening to close the opening while maintaining the substantially spherical interior volume when the laundry bag is in a closed state, the closure includes an additional body of openwork material extending from the opening and having an open end for inserting objects into the interior volume, and in a closed state the openwork material is substantially continuous about the interior volume when the opening is closed by the closure additional body of openwork material being flattened and folded upon itself.

2. The laundry bag according to claim 1, wherein the additional body of openwork material includes a generally cylindrical shaped neck portion when the laundry bag is in the open state such that objects can be inserted into the interior volume and further wherein the open end thereof is substantially equal in size to the opening to the interior volume.

3. The laundry bag according to claim 1, wherein the open end has an opening larger in size than the opening to the interior volume.

4. The laundry bag according to claim 1, wherein the open end has an opening smaller in size than the opening to the interior volume.

5. A method of using a laundry bag, comprising the steps of:

providing a laundry bag including a body of openwork material defining an interior volume and having an opening for insertion of objects into the interior volume, wherein the body of openwork material includes a closure portion of openwork material adjacent the opening;

inserting objects into the interior volume defined by the body of openwork material; and folding the closure portion of openwork material to close the opening such that when folded the interior volume is substantially maintained and the body of openwork material is substantially continuous about the interior volume which is a substantially spherical interior volume in at least one state.

6. The method according to claim 5, further including the step of maintaining the folded position during use of the bag with a fastener.

7. The method according to claim 6, wherein the maintaining step includes the step of pinning the folded closure portion of openwork material.

8. The method according to claim 6, wherein the fastener is labeled.

9. The method according to claim 5, wherein the closure portion of openwork material includes a generally cylindrical neck portion, and the folding step includes the steps of:

flattening the neck portion resulting in a first and second corner of the neck portion;

folding the first corner and second corner downward and toward each other resulting in a generally triangular-shaped folded neck;

folding the generally triangular-shaped folded neck portion downward towards the body of openwork material; and inserting a fastener through the folded generally triangular shaped folded neck portion.

* * * * *